US008836635B2

(12) United States Patent
Mori et al.

(10) Patent No.: US 8,836,635 B2
(45) Date of Patent: Sep. 16, 2014

(54) DISPLAY DEVICE, BRIGHTNESS ADJUSTMENT DEVICE, BACKLIGHT DEVICE, AND METHOD OF ADJUSTING BRIGHTNESS TO PREVENT A FLASH FROM OCCURING

(75) Inventors: Hideto Mori, Tokyo (JP); Yasuo Inoue, Tokyo (JP)

(73) Assignee: Sony Corporation, Tokyo (JP)

( * ) Notice: Subject to any disclaimer, the term of this patent is extended or adjusted under 35 U.S.C. 154(b) by 332 days.

(21) Appl. No.: 13/127,748

(22) PCT Filed: Dec. 9, 2009

(86) PCT No.: PCT/JP2009/070598

§ 371 (c)(1),
(2), (4) Date: May 5, 2011

(87) PCT Pub. No.: WO2010/067816

PCT Pub. Date: Jun. 17, 2010

(65) Prior Publication Data

US 2011/0205442 A1 Aug. 25, 2011

(30) Foreign Application Priority Data

Dec. 11, 2008 (JP) ..... 2008-316292

(51) Int. Cl.
*G09G 3/34* (2006.01)
*G09G 3/32* (2006.01)

(52) U.S. Cl.
CPC ..... *G09G 3/3208* (2013.01); *G09G 2320/0247* (2013.01); *G09G 2320/0666* (2013.01); *G09G 2320/064* (2013.01); *G09G 2360/16* (2013.01); *G09G 2320/0626* (2013.01); *G09G 2320/041* (2013.01); *G09G 2360/145* (2013.01); *G09G 3/3426* (2013.01)
USPC ..... 345/102; 345/77

(58) Field of Classification Search
USPC ..... 345/77, 102
See application file for complete search history.

(56) References Cited

U.S. PATENT DOCUMENTS

2006/0221326 A1* 10/2006 Cok et al. ..... 356/121
2007/0126672 A1 6/2007 Tada et al.

(Continued)

FOREIGN PATENT DOCUMENTS

JP 2005 283909 10/2005
JP 2006 163068 6/2006

(Continued)

OTHER PUBLICATIONS

U.S. Appl. No. 13/131,617, filed May 27, 2011, Mori.

(Continued)

*Primary Examiner* — William Boddie
*Assistant Examiner* — Andrew Schnirel
(74) *Attorney, Agent, or Firm* — Oblon, Spivak, McClelland, Maier & Neustadt, L.L.P.

(57) ABSTRACT

A display device is provided, including circuitry configured to calculate a table representing a relationship between an average brightness and a gain of a video signal; revise the table in order to reduce a change amount of a gain of each frame in the table; calculate an average brightness of a video signal input for each frame; calculate a gain of a video signal from the table based on the calculated average brightness; adjust a video signal using the calculated gain; and a display panel that includes a plurality of pixels that emit light in response to a video signal and displays a video based on the adjusted video signal. A brightness adjustment device, a backlight device, and a method of adjusting brightness, each including the circuitry, are also provided.

12 Claims, 7 Drawing Sheets

(56) References Cited

U.S. PATENT DOCUMENTS

| | | | | |
|---|---|---|---|---|
| 2008/0094346 | A1* | 4/2008 | De Greef | 345/102 |
| 2008/0284767 | A1 | 11/2008 | Mori et al. | |
| 2008/0310752 | A1* | 12/2008 | Han et al. | 382/274 |
| 2009/0267876 | A1* | 10/2009 | Kerofsky | 345/87 |
| 2010/0127957 | A1 | 5/2010 | Meguro et al. | |
| 2011/0227966 | A1* | 9/2011 | Mori | 345/690 |

FOREIGN PATENT DOCUMENTS

| | | |
|---|---|---|
| JP | 2006 243435 | 9/2006 |
| JP | 2007 86277 | 4/2007 |
| JP | 2007 147868 | 6/2007 |
| JP | 2007 298693 | 11/2007 |
| JP | 2008 268500 | 11/2008 |
| WO | 2008 143130 | 11/2008 |
| WO | 2008 146742 | 12/2008 |

OTHER PUBLICATIONS

International Search Report Issued Mar. 2, 2010 in PCT/JP09/070598 filed Dec. 9, 2009.

U.S. Appl. No. 13/394,438, filed Mar. 6, 2012, Mori.

Japanese Office Action Issued Jan. 8, 2013 in Patent Application No. 2008-316292.

* cited by examiner

DISPLAY DEVICE, BRIGHTNESS ADJUSTMENT DEVICE, BACKLIGHT DEVICE, AND METHOD OF ADJUSTING BRIGHTNESS TO PREVENT A FLASH FROM OCCURING

TECHNICAL FIELD

The present invention relates to a display device, a brightness adjustment device, a backlight device, a method of adjusting brightness, and a program.

BACKGROUND ART

Conventionally, as a flat thin display device, a liquid crystal display (LCD) device using a liquid crystal, a plasma display device using plasma, and the like have been put into practical use.

The LCD device is a display device in which a backlight device is installed, and an image is displayed such that when a voltage is applied, an arrangement of liquid crystal molecules changes to pass or block light from the backlight. The plasma display device is a display device that displays an image such that a voltage is applied to a gas sealed in a substrate to create a plasma state, and ultraviolet light generated by energy generated when an original state is returned from the plasma state is irradiated to a phosphor and thus converted to visible light.

Meanwhile, in recent years, a light-emitting type display device using an organic electroluminescence (EL) device in which a device itself emits light when a voltage is applied has been developed. The organic EL device changes from a ground state to an excited state when energy is received by electrolysis and emits energy of a difference as light when the ground state is returned from the excited state. An organic EL display device displays an image using light emitted from the organic EL device.

Unlike the LCD device that requires the backlight, the light-emitting type display device does not require the backlight since the device emits light by itself. Thus, the light-emitting type display device can be configured thinner than the LCD device. Further, compared to the LCD device, the organic EL display device is excellent in a moving image characteristic, a viewing angle characteristic, color reproducibility, and the like and thus has attracted attention as a next generation flat thin display device.

In this circumstance, as stated in the following Patent Literature 1, in a light-emitting type display device such as an organic EL display, a technique of reducing an electric current flowing through the panel to less than a maximum current and reducing peak brightness based on information of a video signal from a panel protection standpoint has been known.

CITATION LIST

Patent Literature

Patent Literature 1: Japanese Patent Application Laid-Open (JP-A) No. 2007-147868.

SUMMARY OF INVENTION

Technical Problem

In the above conventional technique, in order to reduce power consumption, a current value is reduced to less than a maximum current, and peak brightness is reduced. However, although panel power consumption can be reduced by limiting the maximum current, there is a problem in that a brightness change of a screen with respect to a video signal of each frame becomes larger. In this case, a user may feel as if flashing light occurs in a screen, and there is a problem in that visibility of a screen deteriorates.

The present invention is made in view of the above-mentioned issue, and aims to provide a display device, a brightness adjustment device, a backlight device, a method of adjusting brightness, and a program which are novel and improved, and which are capable of reliably preventing flashing light such as flashes from occurring in a video.

Solution to Problem

According to a first aspect of the present invention, in order to achieve the above-mentioned object, there is provided a display device including a table calculation unit that calculates a table representing a relationship between an average brightness and a gain of a video signal, a table revision unit that revises the table in order to reduce a change amount of a gain of each frame in the table, an average brightness calculation unit that calculates an average brightness of a video signal input for each frame, a gain calculation unit that calculates a gain of a video signal from the table based on the average brightness calculated by the average brightness calculation unit, a video signal adjustment unit that adjusts a video signal using the gain calculated by the gain calculation unit, and a display panel that includes a plurality of pixels that emit light in response to a video signal and displays a video based on a video signal adjusted by the video signal adjustment unit.

According to the above configuration, a table representing a relationship between an average brightness and a gain of a video signal is calculated, and the table is revised in order to reduce a change amount of a gain of each frame. An average brightness of a video signal input for each frame is calculated, and a gain of a video signal is calculated from the table based on the calculated average brightness. A video signal is adjusted using the calculated gain, and a video is displayed based on the adjusted video signal. By revising the table in order to reduce a change amount of a gain for each frame, it is possible to prevent a flash from occurring due to an abrupt brightness change in a video.

The table revision unit may revise the table so that a change amount of a gain with respect to a change amount of an average brightness is equal to or less than a predetermined value.

According to a second aspect of the present invention, in order to achieve the above-mentioned object, there is provided a brightness adjustment device including a table calculation unit that calculates a table representing a relationship between an average brightness and a gain of a video signal, a table revision unit that revises the table in order to reduce a change amount of a gain of each frame in the table, an average brightness calculation unit that calculates an average brightness of a video signal input for each frame, a gain calculation unit that calculates a gain of a video signal from the table based on the average brightness calculated by the average brightness calculation unit, and a video signal adjustment unit that adjusts a video signal using the gain calculated by the gain calculation unit.

The table revision unit may revise the table so that a change amount of a gain with respect to a change amount of an average brightness is equal to or less than a predetermined value.

According to a third aspect of the present invention, in order to achieve the above-mentioned object, there is provided a backlight device including a table calculation unit that calculates a table representing a relationship between an average brightness and a gain of a video signal input to a surface light source, a table revision unit that revises the table in order to reduce a change amount of a gain of each frame in the table, an average brightness calculation unit that calculates an average brightness of a video signal input for each frame, a gain calculation unit that calculates a gain of a video signal from the table based on the average brightness calculated by the average brightness calculation unit, and a video signal adjustment unit that adjusts a video signal using the gain calculated by the gain calculation unit.

The table revision unit may revise the table so that a change amount of a gain with respect to a change amount of an average brightness is equal to or less than a predetermined value.

According to a fourth aspect of the present invention, in order to achieve the above-mentioned object, there is provided a method of adjusting a brightness including the steps of calculating a table representing a relationship between an average brightness and a gain of a video signal, revising the table in order to reduce a change amount of a gain of each frame in the table, calculating an average brightness of a video signal input for each frame, calculating a gain of a video signal from the table based on the calculated average brightness, and adjusting a video signal using the gain calculated by the gain calculation unit.

According to a fifth aspect of the present invention, in order to achieve the above-mentioned object, there is provided a program causing a computer to execute the steps of calculating a table representing a relationship between an average brightness and a gain of a video signal, calculating a table representing a relationship between an average brightness and a gain of a video signal based on various conditions acquired by the setting condition acquisition unit, revising the table in order to reduce a change amount of a gain of each frame in the table, calculating an average brightness of a video signal input for each frame, calculating a gain of a video signal from the table based on the calculated average brightness, and adjusting a video signal using the gain calculated by the gain calculation unit.

Advantageous Effects of Invention

According to the present invention, it is possible to provide a display device, a brightness adjustment device, a backlight device, a method of adjusting brightness, and a program which are capable of reliably preventing flashing light such as flashes from occurring in a video.

DESCRIPTION OF EMBODIMENTS

Hereinafter, preferred embodiments of the present invention will be described in detail with reference to the appended drawings. Note that, in this specification and the drawings, elements that have substantially the same function and structure are denoted with the same reference signs, and repeated explanation is omitted. Further, a description will be made in the following order.

1. Configuration of Display Device According to Embodiment of Present Invention
2. Example of Table Retained in Current-Brightness Control Table
3. Various Information for Setting Video Gain
4. Technique of Controlling Peak Brightness and Power Consumption
5. Example of Configuration of Current-Brightness Table Calculation Unit
6. Operation of Flash Control Calculation Unit
7. Process Procedure of Method of Adjusting Brightness
8. Application of Backlight Device.

[1. Configuration of Display Device According to Embodiment of Present Invention]

Figure 1:
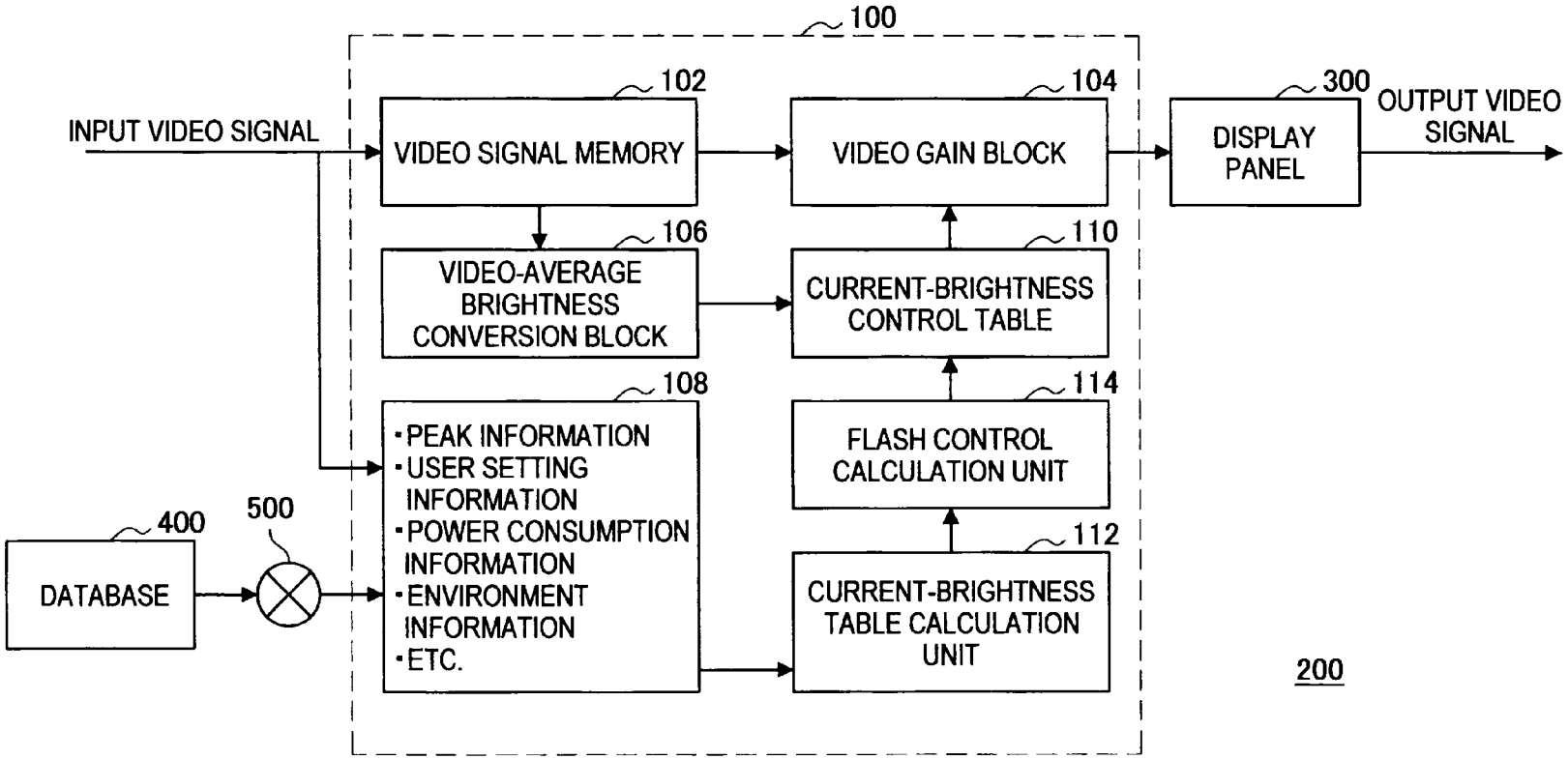
FIG. 1 is a schematic diagram illustrating a configuration of a display device according to an embodiment of the present invention.

FIG. 1 is a schematic diagram illustrating a configuration of a display device 200 according to an embodiment of the present invention. For example, the display device 200 is a device such as a television set and displays a television program based on a video signal obtained from a broadcast wave. The display device 200 includes a brightness adjustment device 100 and a display panel 300. The video signal is input to the brightness adjustment device 100 where brightness is adjusted and then transmitted to the display panel 300. The display panel 300 displays a video based on the adjusted video signal.

In the present embodiment, the display device 300 is configured with a light-emitting type panel. In the present embodiment, an organic EL panel is described as the display panel 300. The display panel 300 receives the video signal whose brightness is adjusted, causes an organic EL device that is an example of a light-emitting device to emit light in response to an input signal and pulse, and displays a moving image or a still image. A surface of the display panel 300 for displaying an image has a flat shape. The organic EL device is a light-emitting type device that emits light when a voltage is applied, and a light emission amount is in proportion to a voltage. Thus, an IL characteristic (a current-light emission amount characteristic) of the organic EL device also has a proportional relationship.

If the video signal is supplied, the display device 100 displays a video through the display panel 300 by lighting up pixels arranged inside the display panel 300 according to the video signal. In the display panel 300, a scan line for selecting a pixel at a predetermined scan period, a data line for providing brightness information for driving a pixel, and a pixel circuit for controlling a current amount based on the brightness information and causing the organic EL device, which is the light-emitting device, to emit light according to the current amount are configured to be arranged in the form of a matrix. The scan line, the data line, and the pixel circuit are configured as described above, and thus the display panel 300 can display the video according to the video signal.

As illustrated in FIG. 1, the brightness adjustment device 100 includes a video signal memory 102, a video gain block 104, a video-average brightness conversion block 106, and a setting condition acquisition unit 108 that acquires a setting condition such as peak information, power consumption information, environment information, or the like. The brightness adjustment device 100 further includes a current-brightness control table 110, a current-brightness table calculation unit 112, and a flash control calculation unit 114. Each of the functional blocks illustrated in FIG. 1 may be configured by hardware (a circuit) or an arithmetic processing unit (CPU) and software (a program) for causing it to function. When each functional block is configured by the arithmetic processing unit and the software, the program may be stored in a memory included in the display device 200 or a recording medium such as a memory inserted from the outside. For example, the setting condition acquisition unit 110 and the current-brightness table calculation unit 112 may be configured by the arithmetic processing unit and the software for causing it to function, and the other functional blocks may be configured by hardware.

The brightness adjustment device 100 receives the video signal for displaying the video on the display panel 300. Here, if it is assumed that the moving image is displayed on the display panel 300, the video signal is input for each frame of the moving image. The brightness adjustment device 100 performs brightness adjustment on the video signal of each frame through the video gain block 104 and transmits the adjusted video signal to the display panel 300.

Hereinafter, each of the functional blocks of the brightness adjustment device 100 illustrated in FIG. 1 will be described. The video signal memory 102 may be configured with a typical frame memory and temporarily store the video signal that is input for each frame. The video-average brightness conversion block 106 calculates an average brightness of each frame by averaging brightness of all pixels on the video signal of each frame. The calculated average brightness is transmitted to the current-brightness control table 110. The video signal is transmitted to the video gain block 104 for each frame.

The video-average brightness conversion block 106 calculates an electric current flowing through the display panel 300. In a device such as an organic EL panel or a light-emitting diode (LED) display, since an electric current and brightness are uniquely decided by a linear relationship, it is possible to easily estimate a consumption current based on brightness of the video signal stored in the video signal memory 102, a color difference signal, and R, G, and B signals.

The current-brightness control table 110 retains a table in which a relationship between an average brightness and a video gain is defined. The current-brightness control table 110 is a table for converting a gain amount by which the video signal is multiplied from an average brightness (an average video signal level) obtained from the video signal for controlling a maximum brightness or a current value based thereon. As will be described later, this table is created by the current-brightness table calculation unit 112 according to various conditions. The current-brightness control table 110 calculates the video gain based on the average brightness transmitted from the video-average brightness conversion block 106 or the current value by using the table. The calculated video gain is transmitted to the video gain block 104.

The video gain block 104 multiplies the corresponding video signal input from the video signal memory 102 by the video gain calculated by the current-brightness control table 110. As a result, the brightness of the video signal is optimally adjusted. As described above, in the present embodiment, by temporarily retaining the video signal in the video signal memory 102, a video signal of a certain frame can be adjusted using a video gain calculated based on an average brightness of the frame.

Further, in a case in which it is configured to adjust a video signal of the next or later frame using the calculated video gain, the video signal memory 102 may not be installed, and the input video signal can be input directly to the video gain block 104 and the video-brightness conversion block 106. In this case, it is preferable to have an overcurrent control function for protecting the display panel 300.

[2. Example of Table Retained in Current-Brightness Control Table]

Figure 2:
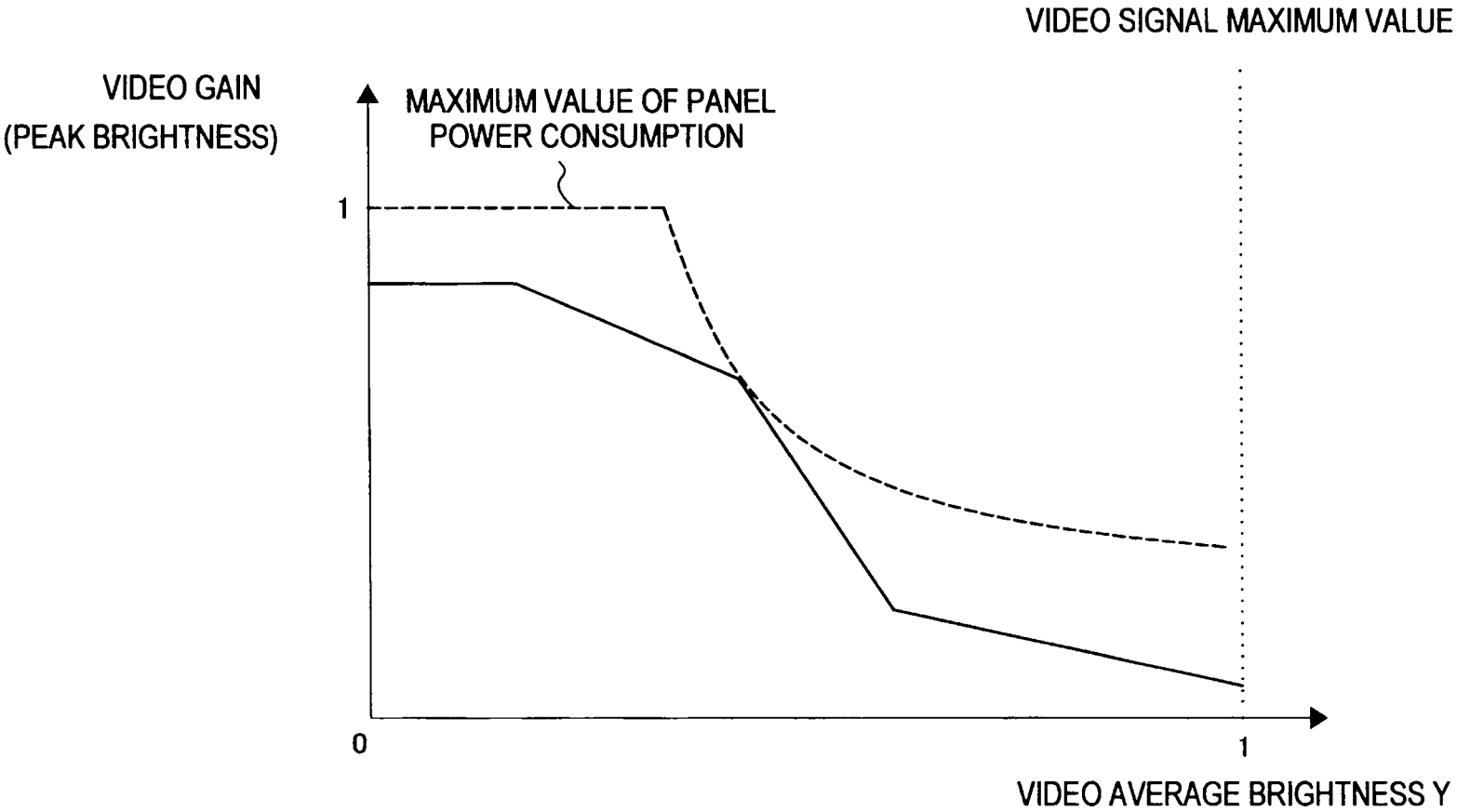
FIG. 2 is a characteristic diagram illustrating an example of a table retained in a current-brightness control table.

FIG. 2 is a characteristic diagram illustrating an example of a table retained in the current-brightness control table 110. A horizontal axis denotes an average brightness of a video, and a vertical axis denotes a video gain.

In FIG. 2, a characteristic indicated by a solid line represents a relationship between a video average brightness and a video gain created by the current-brightness table calculation unit 112 according to various conditions. This characteristic is basically set so that if an average brightness increases, a video gain decreases. Thus, when a video is bright and an average brightness is high, a video gain is set to a small value. Further, when a video is dark and an average brightness is low, a video gain is set to a large value.

In FIG. 2, a characteristic indicated by a dotted line represents a maximum value of power consumption of the display panel 300, and this characteristic is previously determined based on a characteristic of the display panel 300. By making the characteristic of the average brightness and the video gain indicated by the solid line equal to or less than the characteristic of the dotted line, the power consumption of the display panel 300 can be equal to or less than the maximum value, deterioration of the display panel 300 can be prevented, and power consumption can be reduced.

In the present embodiment, the characteristic of the solid line illustrated in FIG. 2 is rewritten at a predetermined time interval and set on a case-by-case basis, according to various conditions such as information of peak brightness (peak information), information set by the user, power consumption information, and environment information. The setting condition acquisition unit 108 has a function of acquiring the various conditions.

[3. Various Information for Setting Video Gain]

Hereinafter, the various information acquired by the setting condition acquisition unit 108 will be described. The information of peak brightness is a condition for setting a maximum brightness in the characteristic of the solid line in FIG. 2 and is mainly decided by information set by the user (user-set information) and environment information (information such as the temperature, humidity, lightness, and color temperature of a place where the display device 200 is placed).

The user-set information is set by the user operating an operation button (not shown) of the display device 200 and includes information such as brightness of a video, a contrast, power consumption (a normal mode or a power save mode), and an image quality mode. The user can set the information to a desired value by operating the operation button.

For example, when the user performs setting for reducing brightness through the user-set information, the characteristic of the solid line of FIG. 2 is set by the current-brightness table calculation unit 112 so that the peak brightness can decrease. In this case, the characteristic of the solid line of FIG. 2 changes so that the maximum value of the video gain can further decrease.

The display device 200 may include a temperature sensor, a humidity sensor, a brightness sensor, a color difference sensor, or the like for acquiring the environment information, and the environment information may be acquired from the sensors. Alternatively, the environment information may be acquired from a predetermined database 400. In this case, the database 400 and the brightness adjustment device 100 may be connected via a network such as the Internet 500.

For example, when it is judged by the brightness sensor that external light of a place where the display device 200 is placed is bright, the current-brightness table calculation unit 112 sets the characteristic of the solid line of FIG. 2 so that the peak brightness can further increase. As a result, even in a bright room, a video that is easy for a viewer to watch can be displayed.

The video signal is also input to the setting condition acquisition unit 108. When it is judged, based on an average value of the video signal or the like, that the brightness of the video is high, the current-brightness table calculation unit 112 sets the characteristic of the solid line of FIG. 2 so that the peak brightness can decrease. As a result, it is possible to prevent the viewer from experiencing glare.

The power consumption information is information corresponding to the characteristic of the dotted line of FIG. 2 and is previously decided according to a characteristic of the display panel 300. The current-brightness table calculation unit 112 sets the characteristic of the average brightness and the video gain indicated by the solid to be equal to or less than the characteristic of the dotted line. As a result, panel power consumption can be prevented from exceeding an allowable range, and deterioration of the display panel can be suppressed. Further, it is possible to minimize power consumption of the display device 200. If the characteristic indicated by the solid line exceeds the characteristic of the dotted line, the current-brightness table calculation unit 112 sets the characteristic of the solid line to overlap with the characteristic of the dotted line on the exceeded portion. As a result, it is possible to reliably prevent the power consumption from exceeding the allowable range.

The setting condition acquisition unit 108 acquires various metadata as the other information. For example, the metadata is information acquired from the video signal and includes information such as a genre of a video (a news program, a drama, a movie, etc.), a title of a video, and a current weather (when a video is a weather forecast). The various metadata may be acquired from the database 400.

When it is detected, based on the metadata acquired from the video signal or the database 400, that a video is a variety program, the current-brightness table calculation unit 112 sets the characteristic so that the peak brightness can decrease. As a result, when a program having a relatively high average brightness such as a variety program is broadcast, it is possible to prevent the viewer from experiencing excessive glare. For example, even when a video of a starry sky is displayed, a video of a clearer starry sky can be provided by increasing the peak brightness.

The current-brightness table calculation unit 112 performs a calculation based on the various setting conditions acquired by the setting condition acquisition unit 108 and sets the characteristic indicated by the solid line of FIG. 2. For example, when it is detected by the sensor for acquiring the above described environment information that external light brightness of a place where the display device 200 is placed is high, the characteristic of the solid line of FIG. 2 is set so that the peak brightness can further increase. In a case in which setting of reducing power consumption is performed, for example, when the user sets an energy save mode, the characteristic of the solid line of FIG. 2 is set so that power consumption can further decrease.

[4. Technique of Controlling Peak Brightness and Power Consumption]

Figure 3:
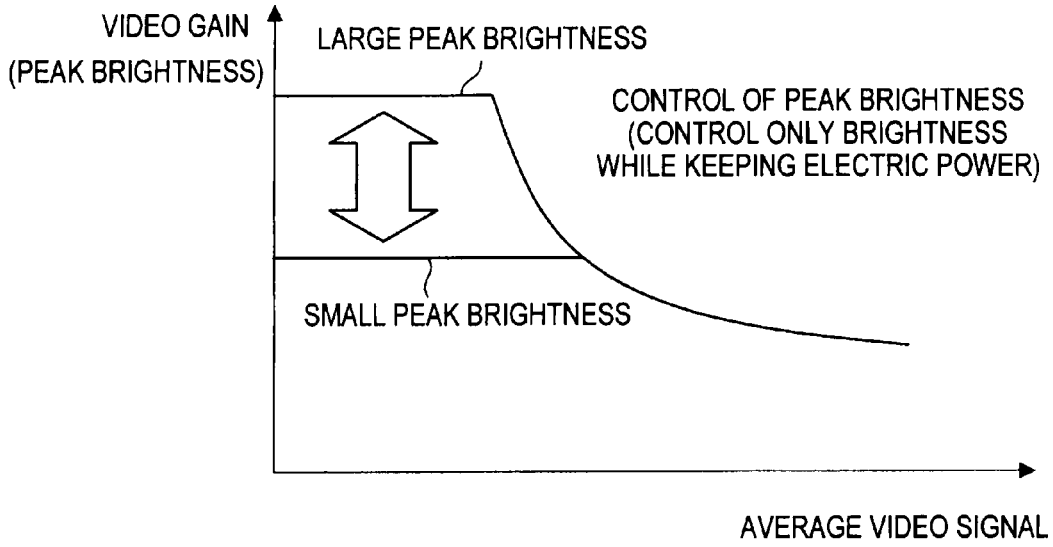
FIG. 3 is a schematic diagram illustrating a technique of controlling a peak brightness and power consumption, respectively, in a characteristic of a solid line of FIG. 2.
Figure 4:
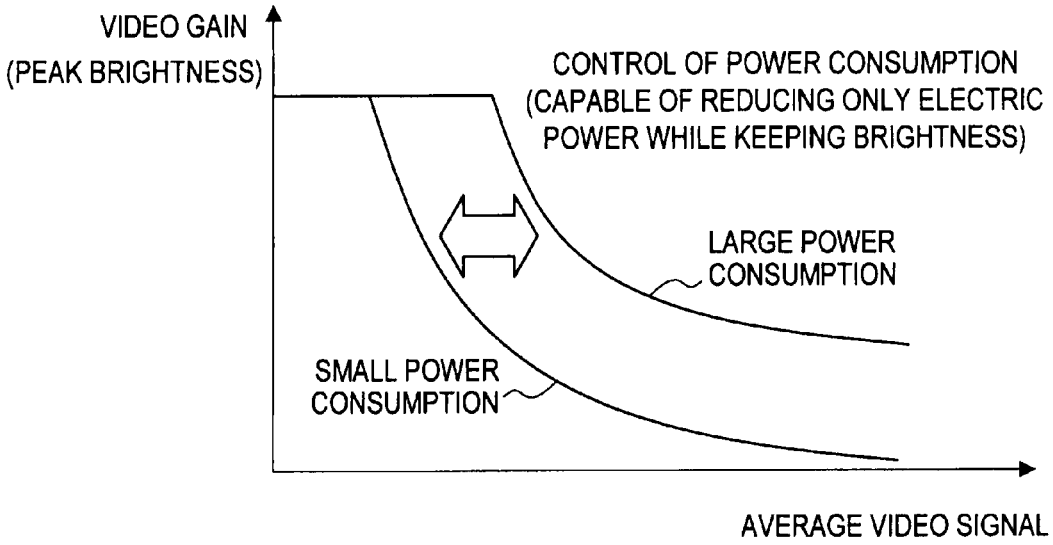
FIG. 4 is a schematic diagram illustrating a technique of controlling a peak brightness and power consumption, respectively, in a characteristic of a solid line of FIG. 2.

FIGS. 3 and 4 are schematic diagrams illustrating a technique of controlling the peak brightness and the power consumption, respectively, in the characteristic of the solid line of FIG. 2. FIG. 3 illustrates a technique of controlling the peak brightness, and FIG. 4 illustrates a technique of controlling the power consumption.

As illustrated in FIG. 3, in the case of controlling the peak brightness, only the peak brightness is controlled by changing the characteristic in a direction indicated by an arrow of FIG. 3 in a state in which the power consumption is kept. Meanwhile, as illustrated in FIG. 4, in the case of controlling the power consumption, only power consumption is controlled by changing the characteristic in a direction indicated by an arrow of FIG. 4 in a state in which the peak brightness is kept. By controlling the peak brightness and the power consumption through the techniques illustrated in FIGS. 3 and 4 as described above, the peak brightness and the power consumption can be individually controlled.

Thus, according to the present embodiment, by individually controlling the peak brightness and the power consumption in a range that does not exceed the characteristic of the dotted line of FIG. 2, the brightness of the video signal can optimally be adjusted in a range equal to or less than maximum power consumption allowed by the display panel 300.

The calculation by the current-brightness table calculation unit 112 is performed, for example, at an interval of 200 [ms] to 1 [s], and the characteristic of the table indicated by the solid line of FIG. 2 is rewritten on a case-by-case basis. The characteristic may be rewritten for each frame.

[5. Example of Configuration of Current-Brightness Table Calculation Unit]

Figure 5:
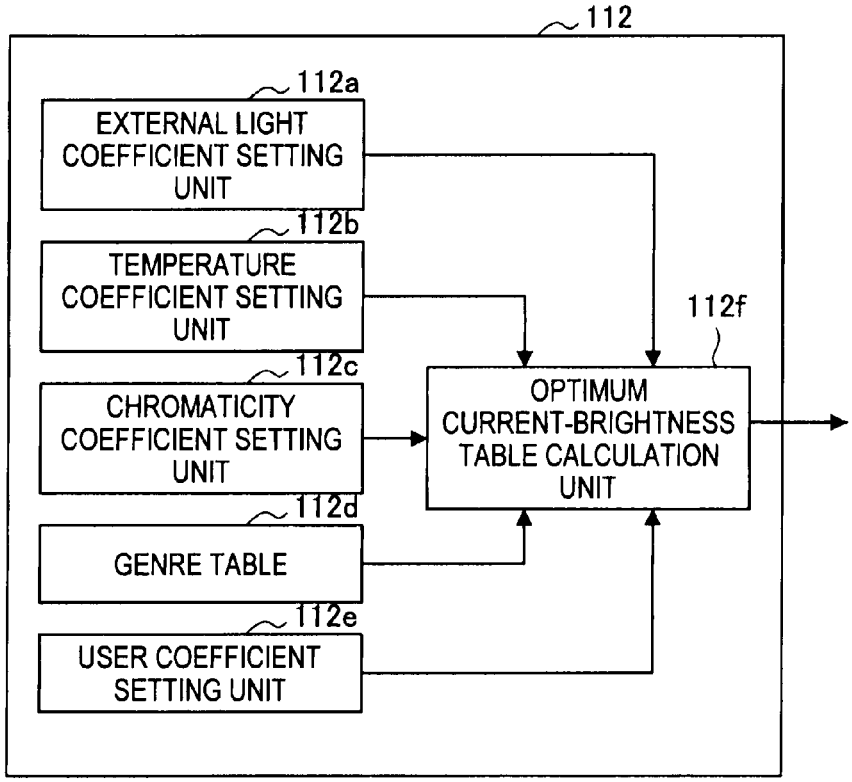
FIG. 5 is a schematic diagram illustrating an example of a configuration of a current-brightness table calculation unit.

FIG. 5 is a schematic diagram illustrating an example of a configuration of the current-brightness table calculation unit 112. As illustrated in FIG. 5, the current-brightness table calculation unit 112 includes an external light coefficient setting unit 112*a*, a temperature coefficient setting unit 112*b*, a chromaticity coefficient setting unit 112*c*, a genre table 112*d*, a user coefficient setting unit 112*e*, and a current-brightness table calculation unit 112*f*. The external light coefficient setting unit 112*a* sets a coefficient based on brightness of external light input as the environment information. The temperature coefficient setting unit 112*b* sets a coefficient based on the temperature input as the environment information. The chromaticity coefficient setting unit 112*c* sets a coefficient based on chromaticity input as the environment information. The genre table 112*d* sets a coefficient based on a genre of a video input as metadata. The user coefficient setting unit 112*e* sets a coefficient based on a setting value set by the user.

The current-brightness table calculation unit 112*f* calculates the characteristic of the solid line illustrated in FIG. 2 based on the coefficients set by the external light coefficient setting unit 112*a*, the temperature coefficient setting unit 112*b*, the chromaticity coefficient setting unit 112*c*, the genre table 112*d*, and the user coefficient setting unit 112*e*.

As described above, according to the brightness adjustment device 100 of the present embodiment, it is possible to individually control the peak brightness and the power consumption in the current-brightness adjustment table according to the setting condition. As a result, the power consumption can be reduced in a state in which contrast feeling originally included in the video signal, a gloss of an object or a human skin, or the like is all maintained. Further, optimum video expression can be made according to the user's viewing environment. Thus, the video can be displayed at optimum brightness and power consumption according to the various conditions.

[6. Operation of Flash Control Calculation Unit]

Next, an operation of the flash control calculation unit 114 will be described. As described above, the brightness adjustment device 100 according to the present embodiment calculates a gain using the table of FIG. 2 based on the average brightness of the video signal and adjusts the video signal through the video gain block 104. Here, when a slope of the characteristic of the solid line in the table of FIG. 2 is steep, the gain greatly changes depending on a change of the average brightness of each frame. In this case, since the brightness greatly changes for each frame, the brightness of the video displayed on the display panel 300 repeats lightness and darkness, and thus the user may experience a flash (flashing light).

This phenomenon easily occurs when the power consumption is limited, particularly, in the light-emitting type panel such as the organic EL panel, and a negative effect occurs in that certain users find it difficult to see the video due to flashing light.

For this reason, the flash control calculation unit 114 calculates a maximum value of the slope of the characteristic of FIG. 2 and revises the characteristic of FIG. 2 so that the maximum value can be equal to or less than a predetermined threshold.

Figure 6:
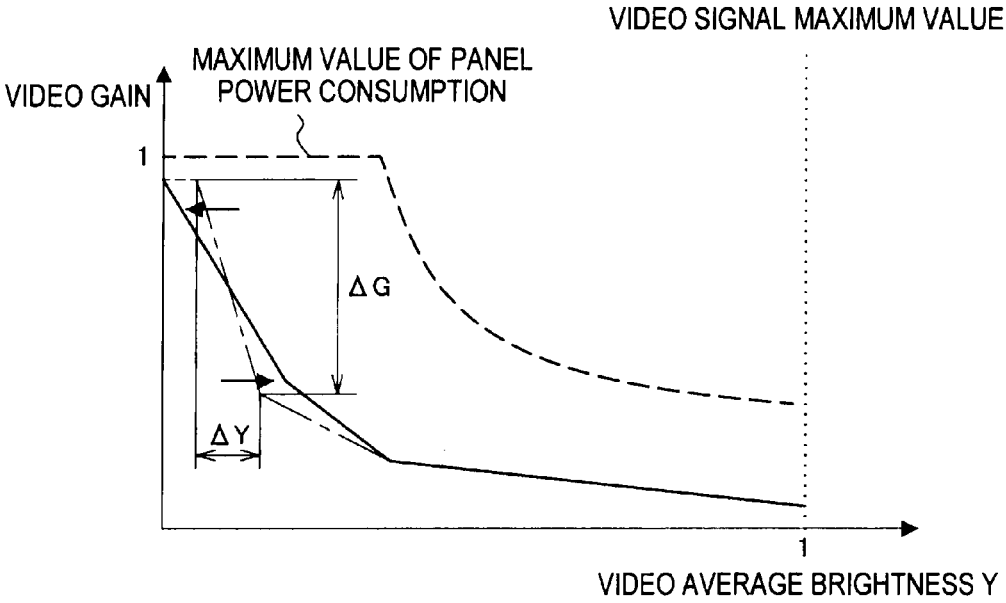
FIG. 6 is a schematic diagram illustrating a process performed by a flash control calculation unit.

Hereinafter, a concrete process will be described with reference to FIG. 6. As illustrated in FIG. 6, if it is assumed that a table calculated by the current-brightness table calculation unit 112 has been a characteristic indicated by a dashed-dotted line in FIG. 6, the flash control calculation unit 114 calculates a slope $\Delta G/\Delta Y$ of the characteristic of the dashed-dotted line. The $\Delta G/\Delta Y$ is compared with a predetermined threshold Th, and when $\Delta G/\Delta Y$ is larger than Th, the characteristic changes so that $\Delta G/\Delta Y$ can be equal to or less than Th.

In the example of FIG. 6, in the characteristic of the dashed-dotted line, since $\Delta G/\Delta Y$ is larger than Th, by changing it to a characteristic of a solid line, the characteristic changes so that a condition expression of $\Delta G/\Delta Y$ can be satisfied.

The table revised by the flash control calculation unit 114 is transmitted to the current-brightness control table 110. The current-brightness control table 110 calculates the gain from the average brightness using the table. The calculated gain is transmitted to the video gain block 104, and the video signal is adjusted by the gain.

[7. Process Procedure of Method of Adjusting Brightness]

Figure 7:
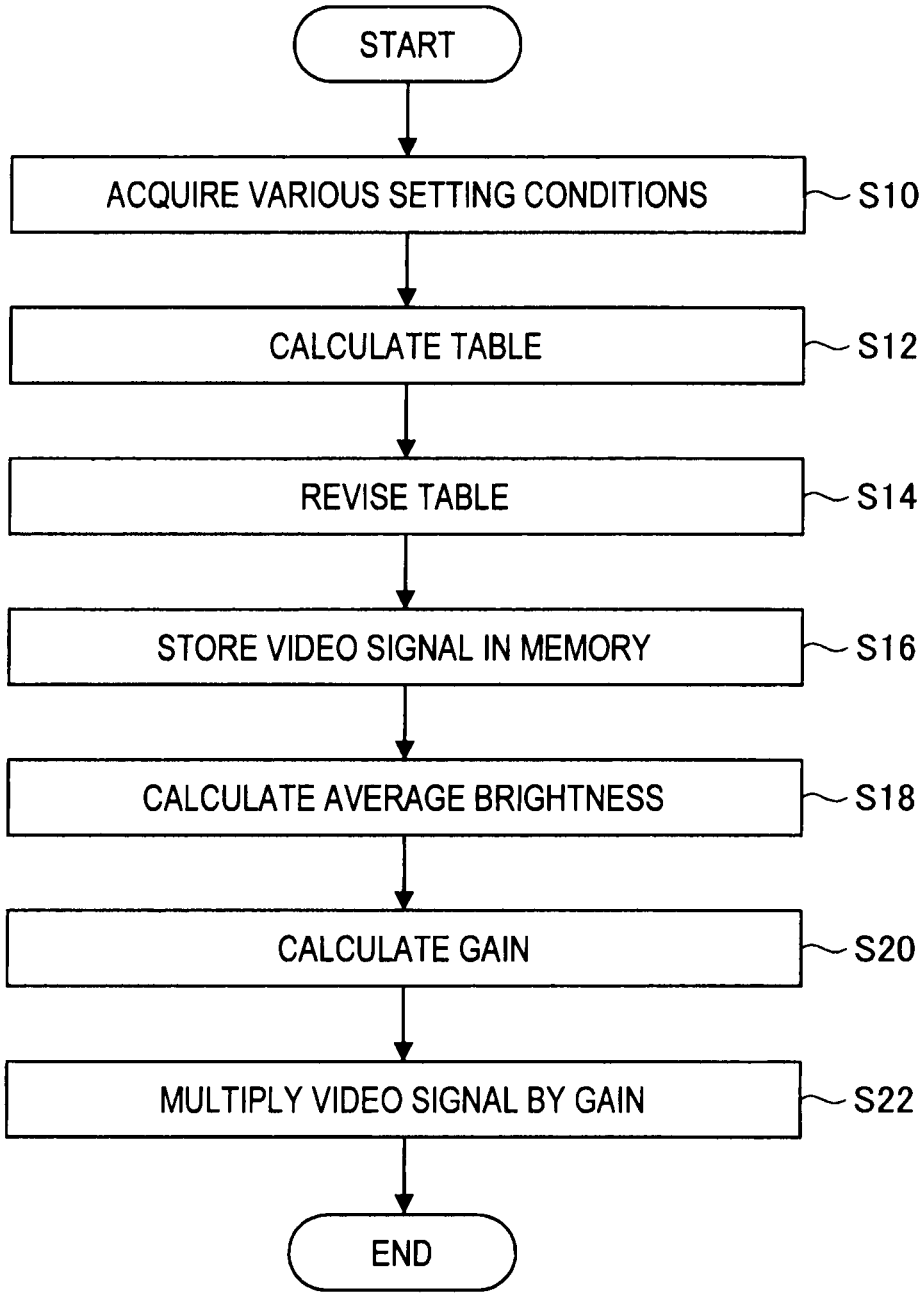
FIG. 7 is a flowchart illustrating a process performed by a brightness adjustment device.

Next, a process performed by the brightness adjustment device 100 will be described. FIG. 7 is a flowchart illustrating a process performed by the brightness adjustment device 100. First, in step S10, the setting condition acquisition unit 108 acquires various setting conditions. In step S12, the current-brightness control table 110 individually sets the peak brightness and the power consumption based on the various setting conditions and calculates the table illustrated in FIG. 2.

In step S14, the flash control calculation unit 114 revises the table calculated in step S12 and transmits the revised table to the current-brightness control table 110.

In step S16, the video frame of each frame is stored in the video signal memory 102. In step S18, the video-average brightness conversion block 106 calculates the average brightness of each frame by averaging brightness of all pixels of the video signal of each frame stored in the video signal memory 102.

In step S20, the average brightness calculated in step S18 is input to the current-brightness control table 110, and the video gain is calculated from the average brightness. In step S22, the video signal of each frame stored in the video signal memory 102 is transmitted to the video gain block 104 and multiplied by the video gain calculated in step S20.

The above described process of the display device 200 may be performed by recording a computer program previously created to execute a corresponding process in a recording medium inside the display device and causing an arithmetic device (for example, a CPU) to sequentially read and execute the corresponding program.

As described above, according to the present embodiment, by freely controlling the setting value of the brightness control table in a range in which there is no problem related to a panel operation, excellent low power consumption performance and video quality can be secured. Further, by causing a slope of a characteristic of a table representing a relationship between the average brightness and the gain to be equal to or less than a predetermined value, it is possible to prevent a flash from occurring in a video in response to a change in average brightness. Thus, it is possible to reliably prevent a phenomenon in which a video becomes difficult to watch due to the occurrence of a flash.

[8. Application of Backlight Device]

Figure 8:
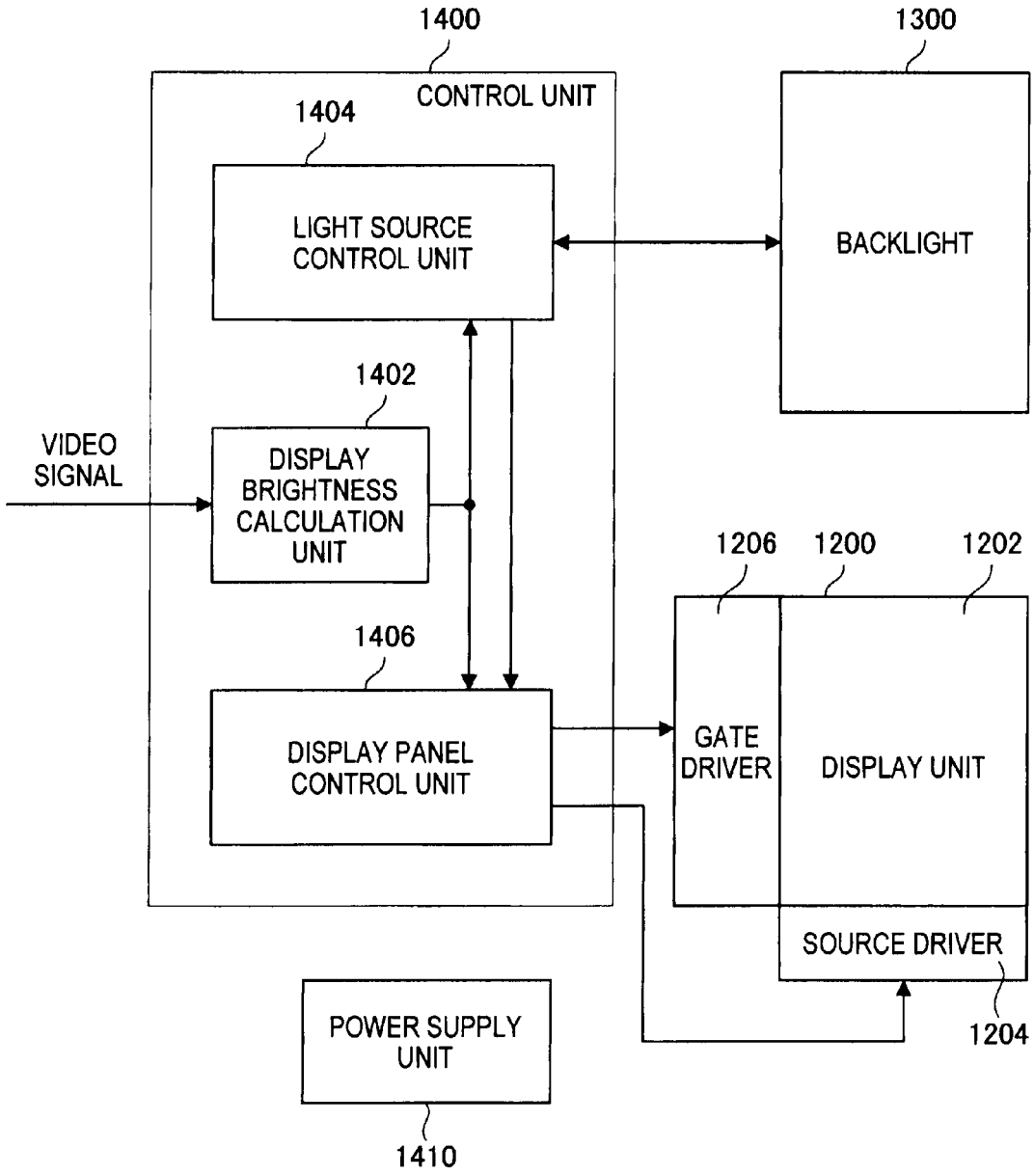
FIG. 8 is a functional block diagram illustrating a configuration of a display device including a backlight device.

Next, an embodiment in which the present invention is applied to a backlight device will be described. The above described example has been described in connection with the brightness adjustment device 100 of the display device 200 including the organic EL panel that is configured to individually control the peak brightness and the power consumption. However, a backlight device used in an LCD device or the like may be configured by a similar configuration. FIG. 8 is a functional block diagram illustrating a configuration of a display device 1000 including a backlight device. In FIG. 8, the display device 1000 is configured with an LCD device.

As illustrated in FIG. 8, the display device 1000 includes a display panel 1200 that includes a color filter substrate, a liquid crystal layer, and the like, a surface light source 1300 disposed on a back side of the display panel 1200, a control unit 1400 that controls the display panel 1200 and the surface light source 1300, and a power supply unit 1410. The control unit 1400 and the power supply unit 1410 may be configured integrally with the display device 1100 or may be configured separately from the display device 1100.

The display device 1100 displays an original image corresponding to an image signal on a predetermined display area (an area corresponding to a display unit 1202 of the display panel 1200). For example, an input image signal input to the display device 1100 corresponds to an image (a frame image) of a frame rate of 60 Hz.

The display panel 1200 includes the display unit 1202 in which a plurality of opening sections through which white light from the surface light source 1300 is passed are arranged. The display panel 1200 includes a source driver 1204 and a gate driver 1206 that transmit a driving signal to transistors (thin film transistors (TFTs) disposed in the opening sections of the display unit 1202.

The white light that has passed through the opening sections of the display unit 1202 is converted to red, green, or blue light by a color filter formed on the color filter substrate (not shown). A set including three opening sections that emit red, green, and blue light corresponds to one pixel of the display unit 1202.

The surface light source 1300 emits the white light in a light-emitting area corresponding to the display unit 1202. The light-emitting area of the surface light source 1300 is divided into a plurality of blocks (areas), and light emission is controlled individually on each of the plurality of divided blocks.

The control unit 1400 includes a display brightness calculation unit 1402, a light source control unit 1404, and a display panel control unit 1406. An image signal corresponding to each frame image is supplied to the display brightness calculation unit 1402. The display brightness calculation unit 1402 obtains a brightness distribution of a frame image from the supplied image signal and calculates display brightness necessary for each block from the brightness distribution of the frame image. The calculated display brightness is supplied to the light source control unit 1404 and the display panel control unit 1406.

The light source control unit 1404 calculates backlight brightness in each block of the surface light source 1300 based on the display brightness of each block supplied from the display brightness calculation unit 402. The light source control unit 1404 controls a light emission amount of a light-emitting diode (LED) 1330 of each block in order to satisfy the calculated backlight brightness through pulse width modulation (PWM) control. Since the light-emitting brightness of the surface light source 1300 can be controlled for each block according to the input image signal as described above, optimal light emission according to an image displayed on the display panel 1200 can be performed. In some cases, controlling the light emitting brightness of the surface light source 1300 for each block according to the input image signal is called divided light-emitting driving or partial light-emitting driving.

The light source control unit 1404 performs light-emitting control for performing correction of light-emitting brightness or chromaticity based on light-emitting brightness or chromaticity of each block detected by a sensor disposed inside the backlight 1300. Here, the sensor includes an illuminance sensor, a color sensor, or the like.

The backlight brightness of each block of the surface light source 1300 calculated by the light source control unit 1404 is supplied to the display panel control unit 1406. The display panel control unit 1406 calculates a liquid crystal aperture ratio of each pixel of the display unit 1202 based on the display brightness of each block supplied from the display brightness calculation unit 1402 and the backlight brightness of each block supplied from the light source control unit 1404. In order to satisfy the calculated light crystal aperture ratio, the display panel control unit 1406 supplies a driving signal to the source driver 1204 and the gate driver 1206 of the display panel 200 and driving-controls the TFT of each pixel of the display unit 202. The power supply unit 1410 supplies each part of the display device 100 with predetermined electric power.

Figure 9:
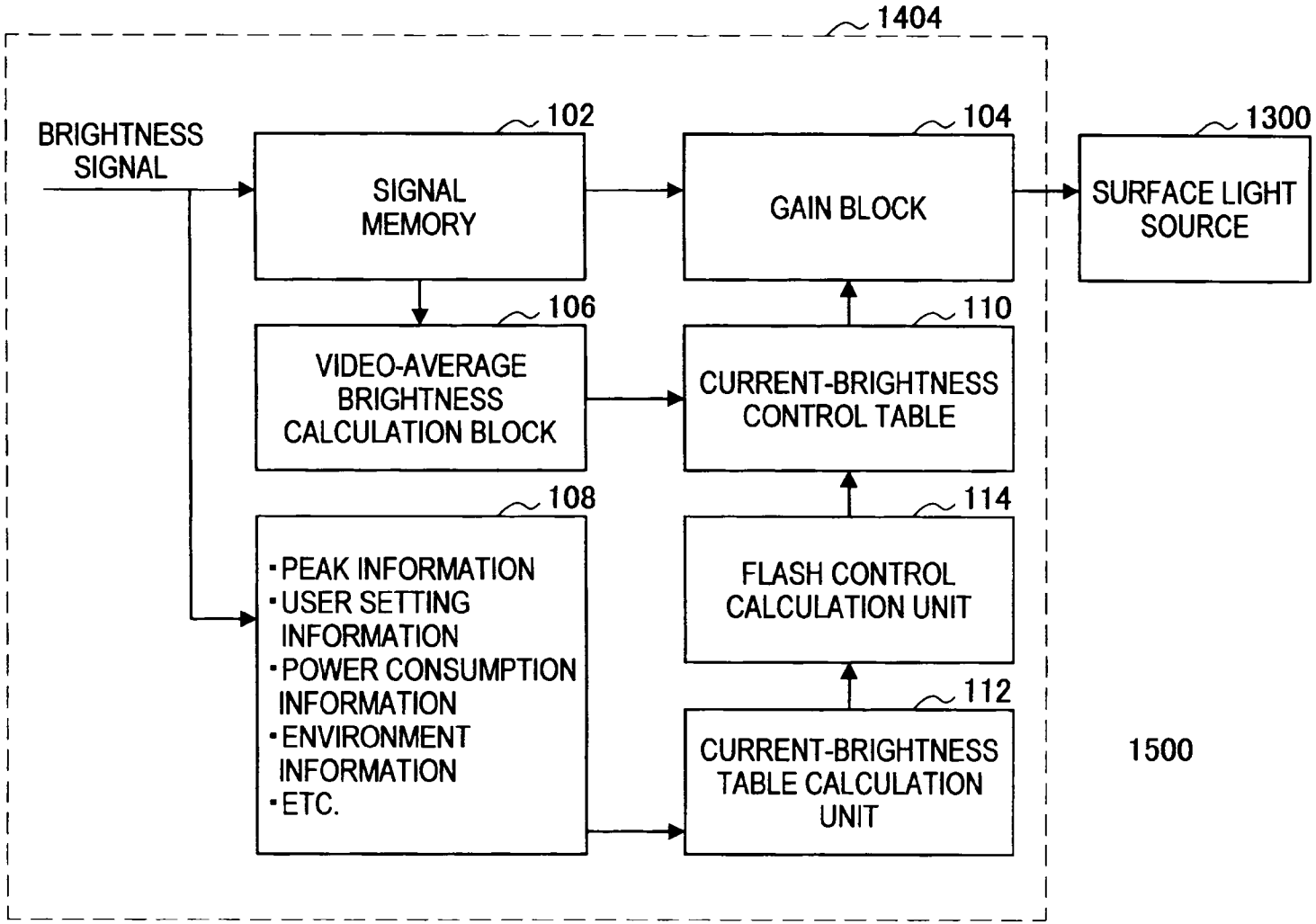
FIG. 9 is a schematic diagram illustrating a configuration of a backlight device that includes a light source control unit and a surface light source.

FIG. 9 is a schematic diagram illustrating a configuration of a backlight device 1500 that includes the light source control unit 1404 and the surface light source 1300. The light source control unit 1404 has a configuration similar to the brightness control device 100 that has been described with reference to FIG. 1. That is, the light source control unit 1404 includes a memory 102, a gain block 104, an average brightness conversion block 106, and a setting condition acquisition unit 108. The brightness adjustment device 100 further includes a current-brightness control table 110, a current-brightness table calculation unit 112, and a flash control calculation unit 114. Each of the functional blocks illustrated in FIG. 9 may be configured by hardware (a circuit) or an arithmetic processing unit (CPU) and software (a program) for causing it to function. When each functional block is configured by the arithmetic processing unit and the software, the program may be stored in a memory included in the display device 200 or a recording medium such as a memory inserted from the outside.

The backlight brightness in each block of the surface light source 1300, which is calculated by the light source control unit 140, is input to the memory 102. The video-average brightness conversion block 104 calculates an average brightness of each frame by averaging brightness of each block on a brightness signal of each frame. The calculated average brightness is transmitted to the current-brightness control table 110. The brightness signal is transmitted to the video gain block 104 for each frame.

The current-brightness control table 110 retains a table in which a relationship between an average brightness and a gain is defined. The current-brightness control table 110 is a table for converting a gain amount by which the video signal is multiplied from an average brightness (an average video signal level) obtained from the video signal for controlling a maximum brightness or a current value based thereon. This table is created by the current-brightness table calculation unit 112 according to various conditions.

Similarly to the first embodiment, the flash control calculation unit 114 calculates a maximum value of a slope in a characteristic of the current-brightness table calculation unit 112 and revises the characteristic so that the maximum value can be equal to or less than a predetermined threshold.

The current-brightness control table 110 calculates the video gain based on the average brightness transmitted from the video-average brightness conversion block 104 using the revised table. The calculated video gain is transmitted to the video gain block 104.

The gain block 104 multiplies the corresponding brightness signal input from the memory 102 by the gain calculated by the current-brightness control table 110. As a result, the brightness of the surface light source 1300 is optimally adjusted.

As described above, in the backlight device 1500 of the LCD device or the like, when the gain is adjusted based on the brightness signal, it is possible to prevent the occurrence of a flash caused by an abrupt change of a gain, and it is possible to supply a video that is easy to view.

The preferred embodiments of the present invention have been described above with reference to the accompanying drawings, whilst the present invention is not limited to the above examples, of course. A person skilled in the art may find various alternations and modifications within the scope of the appended claims, and it should be understood that they will naturally come under the technical scope of the present invention.

INDUSTRIAL APPLICABILITY

For example, the present invention can broadly be applied to a display device used in a television receiver or the like.

REFERENCE SIGNS LIST

100 brightness adjustment device
104 video gain block
106 video-average brightness conversion block
108 setting condition acquisition unit

110 current-brightness control table 110
112 current-brightness table calculation unit
114 flash control calculation unit
200 display device
300 display panel
1500 backlight device

The invention claimed is:

1. A brightness adjustment device, comprising:
circuitry configured to:
calculate a table representing a relationship between an average brightness and a gain of an input video signal, where the gain changes as a function of the average brightness;
calculate a slope of the function and compare the slope to a predetermined value;
revise the table, when the slope is greater than the predetermined value, in order to reduce a change amount of a gain of each frame in the table, such that the reduced change amount of the gain with respect to the change amount of the average brightness is equal to or less than the predetermined value;
calculate an average brightness of each frame of the input video signal;
calculate a gain of a video signal from the revised table based on the calculated average brightness; and
adjust the video signal using the calculated gain.

2. The brightness adjustment device according to claim 1, wherein the circuitry is further configured to individually control a peak brightness and power consumption by:
controlling the peak brightness while the power consumption is kept constant, and
controlling the power consumption while the peak brightness is kept constant.

3. The brightness adjustment device according to claim 1, wherein the circuitry is further configured to rewrite the table representing the relationship on a case-by-case basis.

4. The brightness adjustment device according to claim 1, wherein the circuitry is further configured to calculate the relationship based on one or more coefficients including external light, temperature, chromaticity, genre, and user.

5. A backlight device, comprising:
circuitry configured to:
calculate a table representing a relationship between an average brightness and a gain of a video signal input to a surface light source, where the gain changes as a function of the average brightness;
calculate a slope of the function and compare the slope to a predetermined value;
revise the table, when the slope is greater than the predetermined value, in order to reduce a change amount of a gain of each frame in the table, such that the reduced change amount of the gain with respect to the change amount of the average brightness is equal to or less than the predetermined value;
calculate an average brightness of each frame of the input video signal;
calculate a gain of a video signal from the revised table based on the calculated average brightness; and
adjust the video signal using the calculated gain.

6. The backlight device according to claim 5, wherein the circuitry is further configured to individually control a peak brightness and power consumption by:
controlling the peak brightness while the power consumption is kept constant, and
controlling the power consumption while the peak brightness is kept constant.

7. The backlight device according to claim 5, wherein the circuitry is further configured to rewrite the table representing the relationship on a case-by-case basis.

8. The backlight device according to claim 5, wherein the circuitry is further configured to calculate the relationship based on one or more coefficients including external light, temperature, chromaticity, genre, and user.

9. A method of adjusting a brightness, comprising:
calculating, using circuitry, a table representing a relationship between an average brightness and a gain of an input video signal, where the gain changes as a function of the average brightness;
calculating, using the circuitry, a slope of the function;
comparing, using the circuitry, the slope to a predetermined value;
revising the table, using the circuitry, when the slope is greater than the predetermined value, in order to reduce a change amount of a gain of each frame in the table, such that the reduced change amount of the gain with respect to the change amount of the average brightness is equal to or less than the predetermined value;
calculating, using the circuitry, an average brightness of each frame of the input video signal;
calculating, using the circuitry, a gain of a video signal from the revised table based on the calculated average brightness; and
adjusting, using the circuitry, the video signal using the calculated gain.

10. The method according to claim 9, further comprising individually controlling a peak brightness and power consumption by:
controlling the peak brightness while the power consumption is kept constant, and
controlling the power consumption while the peak brightness is kept constant.

11. The method according to claim 9, further comprising rewriting, using the circuitry, the table representing the relationship on a case-by-case basis.

12. The method according to claim 9, further comprising calculating the relationship based on one or more coefficients including external light, temperature, chromaticity, genre, and user.

* * * * *